US007743919B2

(12) United States Patent
Maeda et al.

(10) Patent No.: US 7,743,919 B2
(45) Date of Patent: Jun. 29, 2010

(54) PACKAGING

(75) Inventors: Mitsuru Maeda, Tokyo (JP); Kozo Odamura, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 12/318,185

(22) Filed: Dec. 23, 2008

(65) Prior Publication Data

US 2009/0169283 A1 Jul. 2, 2009

(30) Foreign Application Priority Data

Dec. 26, 2007 (JP) ..... 2007-333877
Mar. 31, 2008 (JP) ..... 2008-090504

(51) Int. Cl.
*B65D 85/02* (2006.01)

(52) U.S. Cl. ..... 206/391; 206/395; 206/397; 206/585

(58) Field of Classification Search ..... 206/394, 206/391, 593, 585, 784, 408, 389, 446, 225, 206/395, 397; 400/207
See application file for complete search history.

(56) References Cited

U.S. PATENT DOCUMENTS 1,284,082 A * 11/1918 Flanigan ..... 206/408
1,833,356 A * 11/1931 De Witt ..... 206/784
3,389,848 A * 6/1968 McKee ..... 206/521
5,415,486 A * 5/1995 Wouters et al. ..... 400/692
5,813,523 A * 9/1998 Gnadt et al. ..... 206/77.1
5,839,839 A * 11/1998 Brot et al. ..... 400/242
5,904,329 A 5/1999 Kanome et al.
6,266,942 B1 * 7/2001 McClorey ..... 53/390
6,318,554 B1 * 11/2001 Semba ..... 206/389
6,382,551 B1 * 5/2002 Nelson ..... 242/594.1
6,877,606 B2 * 4/2005 Hardy ..... 206/419
2001/0035363 A1 11/2001 Semba
2009/0038971 A1 * 2/2009 Maeda ..... 206/389

FOREIGN PATENT DOCUMENTS

EP 67656 A1 * 12/1982
EP 1 221 379 A1 7/2002
EP 2 025 622 A1 2/2009
JP 07-061081 3/1995
JP 7-69341 3/1995
JP H10-315558 A 12/1998

* cited by examiner

*Primary Examiner*—David T Fidei
(74) *Attorney, Agent, or Firm*—Fitch, Even, Tabin & Flannery

(57) ABSTRACT

Packaging for reliably fixing an irregularly shaped ink ribbon unit includes few components, including a printing paper roll wound with printing paper, an ink ribbon unit having both a sending roll that is wound with an ink ribbon and a winding roll disposed in parallel to the sending roll, a container for holding the printing paper roll and ink ribbon unit, and a partition member that partitions the container into first and second storage regions, into which the printing paper roll and ink ribbon unit are respectively stored. The ink ribbon unit is arranged in such a manner that the direction of the shafts of the sending and winding rolls is parallel to the bottom surface of the second storage region, and the partition member extends with an inclination relative to a direction perpendicular to the bottom surface of the second storage region.

12 Claims, 6 Drawing Sheets

PACKAGING

CROSS-REFERENCE TO RELATED APPLICATIONS

This application claims the benefit of foreign priority under 35 U.S.C. §119 based on JP 2007-333877, filed Dec. 26, 2007, and JP 2007-90504, filed Mar. 31, 2008. The entire disclosures of the preceding applications are hereby incorporated herein by reference.

TECHNICAL FIELD

The present invention relates to packaging in which a printing paper roll and an ink ribbon unit are accommodated.

BACKGROUND ART

Several types of packaging for accommodating rolled products have been proposed. Patent Document 1 is an example thereof. Various forms are employable for packaging rolled products. In recent years, there have been numerous attempts to store accessories together with rolled products in the same package. For example, in terms of a printing paper, which is a rolled product, it is more convenient for users if the printing paper is stored with an ink ribbon unit, which conducts printing on the printing paper roll, in the same package.

Patent Document 1: Japanese Unexamined Patent Publication No. 1995-69341

DETAILED DESCRIPTION

Problem to Be Solved by the Invention

The above-mentioned ink ribbon unit includes a sending roll, onto which an ink ribbon is rolled, and a winding roll, which is arranged parallel to the sending roll. In the ink ribbon unit, the sending roll and the winding roll are arranged in one set. In the unused condition, the sending roll has a larger diameter and the winding roll has a smaller diameter. In the ink ribbon unit, two rolls having different diameters are disposed in parallel, i.e., having irregular shaped components, and therefore it is difficult to fix them in a container. When a cubic or rectangular item having parallel opposing surfaces is stored, it can be fixed to the container with a relatively simple fixture or partition. In contrast, when the above-mentioned item having an irregular shape is stored, a fixer with a complicated shape or additional component becomes necessary to fill the gaps formed by the irregular shape. This increases the number of necessary components.

The present invention aims to solve the above problem, and provides packaging that can reliably store an irregular shaped ink ribbon unit with a smaller number of components.

Means for Solving the Problem

An object of the first packaging of the present invention is to solve the above problem. The first packaging of the present invention includes a printing paper roll that is wound with printing paper; an ink ribbon unit that has both a sending roll that is wound with an ink ribbon and a winding roll that is disposed in parallel to the sending roll; a container for holding the printing paper roll and the ink ribbon unit; and a partition member that partitions the container into a first storage region and a second storage region, into which the printing paper roll and the ink ribbon unit are stored, respectively. The ink ribbon unit is arranged in such a manner that the direction of the shafts of the sending roll and winding roll is parallel to the bottom surface of the second storage region; and the partition member extends with an inclination relative to a direction perpendicular to the bottom surface of the second storage region.

In this structure, the container is partitioned into a first storage region in which the printing paper roll is stored and a second storage region, in which the ink ribbon unit is stored. In the second storage region, the ink ribbon unit is placed in such a manner that the axial direction of the sending roll and the winding roll is parallel to the bottom surface of the second storage region, and the partition member extends with an inclination relative to the surface perpendicular to the bottom surface of the second storage region.

The second storage region is designed so as to become narrower from one end to the other in the direction perpendicular to the bottom surface. Therefore, the ink ribbon unit can be stored by placing the sending roll with a larger diameter in the wider portion, and the winding roll with a smaller diameter in the narrower portion. In other words, this structure provides a storage space that is suitable for an ink ribbon unit having rolls with different diameters, so that such ink ribbon unit can be reliably fixed in position.

The partition member simply separates the printing paper roll and the ink ribbon unit, and therefore special components for filling gaps are not required. This reduces the number of parts necessary and accordingly reduces the production cost. The bottom surface of the second storage region does not necessarily mean the bottom surface of the container and may be any surface. For example, it is possible to define the surface corresponding to the side surface of the container as the bottom surface of the second storage region. There is also no limitation to the direction in which the printing paper roll is placed. A stable arrangement can be obtained by placing the printing paper roll so that its axial direction is perpendicular to the bottom surface of the second storage region.

The second packaging of the present invention aims to solve the above problem. The second packaging of the present invention includes at least two printing paper rolls that are wound with printing paper; at least two ink ribbon units that each has both a sending roll that is wound with an ink ribbon, and a winding roll that is disposed in parallel to the sending roll; a container for holding the printing rolls and the ink ribbon units; and a partition member for partitioning the container into a first region, in which the printing paper rolls are disposed, and a second region, in which the ink ribbon units are disposed. The ink ribbon units are arranged in such a manner that the direction of the shafts of the sending roll and winding roll is parallel to the bottom surface of the second storage region, said at least two ink ribbon units are arranged in such a manner that the gap formed by the difference in the diameters between the winding roll and the sending roll in each ink ribbon unit is engaged with the winding roll of the other ink ribbon unit, and the two sending rolls are arranged to be opposed each other having the two winding rolls therebetween.

In this structure, when two or more printing paper rolls and ink ribbon units are stored, a winding roll of one ink ribbon unit is fitted into the gap that is formed by the difference in the diameters of the winding roll and the sending roll of the other ink ribbon unit. The two sending rolls are arranged to face each other having the two winding rolls in between. In an irregular shaped ink ribbon unit, this arrangement allows the winding rolls, which have a smaller diameter, to adjacently locate, so as to fill the gap formed between the sending rolls, which have a larger diameter. As a result, the formation of unnecessary space in the container can be prevented, and additional components to fill the gaps become unnecessary.

In the first and second packaging, the partition member may be variously modified. For example, the partition member may be provided only at the boundary between the first and second regions. In this case, it is preferable to provide a fixing means so that the partition member will not shift in the container. The partition member may also have the structure as described below:

The printing paper roll is placed in such a manner that its shaft core is perpendicular to the bottom surface of the second storage region. The partition member includes a pair of panel-like holding members for holding the printing paper rolls at their ends in the axial direction, and a panel-like connecting member for connecting the holding members. The connecting member forms a boundary between the first and second regions.

This structure allows the holding members to sandwich the printing paper rolls from the directions perpendicular to their axes. Therefore, by providing another fixing means to the holding member, the printing paper rolls can also be fixed. This arrangement prevents any shift of the printing paper rolls in the container and movement of the partition member itself.

For example, when the printing paper roll has a cylindrical shaft core space in the shaft core, the printing paper roll can be stably fixed in the following manner. Specifically, a shaft fixing member is provided to each of the holding members in such a manner that the shaft fixing member projects toward the printing paper roll to engage with the shaft core space. This structure reduces the necessary space because fixation is achieved by inserting a fixing member into the printing paper roll.

The partition member may have various forms. For example, in the first packaging, one end of the connecting member may be connected to a mid-part of one holding member, and the other end of the connecting member may be connected to the end of the other holding member or in the vicinity thereof. This arrangement makes the connecting member incline relative to the axial direction. Alternatively, the following arrangement may be employed. Specifically, a partition member is integrally formed from one of the holding members, the connecting member, and the other holding member in such a manner that they are aligned in this order in a developed view, wherein the connecting member has a band-like shape having a smaller width than the holding member. The connecting member extends to a mid-part of one of the holding member due to slits formed in the holding member along the direction in which the connecting member extends. Due to this arrangement, the connecting member can be folded at this mid-part. This makes it possible to integrally form the partition member from a single panel, etc., and reduces its cost and simplifies its production. The term "mid-part" means an arbitrary point somewhere between the two ends of the holding member, and it does not have to be the exact midpoint of the holding member.

The second packaging may have a partition member having the same structure as in the first packaging. However, in the second packaging, two ink ribbon units are placed so as to fill the gap in each other. Therefore, the connecting member does not need to be obliquely arranged. In other words, the connecting member may extend between the first and second regions perpendicular to the bottom surface of the second storage region. When the partition member is formed from a single panel, etc., the connecting member may extend to a mid-part of the holding member as described above. When the connecting member extends straightforwardly in the axial direction of the printing paper rolls, the connecting member may extend to a mid-part of the other holding member.

It is also possible to make at least one of the holding members substantially the same size as the portion of the container surface facing the ends of the shaft cores of the printing paper rolls. This makes the holding members to be fixed to the inner surface of the container and prevents any shifting of the holding members in the container. This also prevents any shifting of the printing paper rolls and connecting member.

It is also possible to provide a filling member to fill a gap formed between at least one end of each ink ribbon unit in the axial direction and the inner surface of the container. In most cases, the second packaging is designed to store two or more printing paper rolls and the design of the container is selected based on the shapes of the printing paper rolls. This may cause gaps to be formed between the ink ribbon units and the inner surface of the container. In this case, the gaps can be filled by a filling member as described above, and this also prevents shifting of the ink ribbon units in the container. The filling member may be provided on one or both ends of the ink ribbon units. Such a filling member may also be used in the first packaging. In this case, a filling member having a shape that is suited to the second storage region is prepared, and the thus-prepared filling member is provided for one or both ends of the ink ribbon unit in the axial direction.

The printing paper roll and ink ribbon unit employed in the present invention can be used to print characters as well as to form images. As long as the printing paper is wound into a roll, there is no limitation to the material and size thereof. There is also no limitation to the ink ribbon.

The third packaging of the present invention aims to solve the above problem. The third packaging includes a printing paper roll that is wound with printing paper; an ink ribbon unit that has both a sending roll that is wound with an ink ribbon and a winding roll that is disposed in parallel to the sending roll; a container for folding the printing paper roll and the ink ribbon unit, and a partition member disposed in the container for partitioning the printing paper roll and the ink ribbon unit.

The partitioning member has a pair of panel-like holding members for holding the printing paper roll at the ends in the axial direction and a panel-like connecting member for connecting the holding members.

The connecting member extends in an angle relative to the axial direction, and partitions the container in the radial direction, into a first storage region and a second storage region, into which the printing paper roll and the ink ribbon unit are stored, respectively.

In this structure, the connecting member of the partition member partitions the container in such a manner that the printing paper roll and the ink ribbon unit are aligned in the radial direction of the printing paper roll. The connecting member obliquely extends relative to the axial direction of the printing paper roll. Therefore, the second storage region, in which the ink ribbon unit is stored, becomes smaller from one end of the shaft core to the other end. The ink ribbon unit can be stored in such a manner that the sending roll, which has a larger diameter, is disposed at one end of the printing paper roll, and the winding roll, which has a smaller diameter, is disposed at the other end. Accordingly, a space suitable for accommodating an ink ribbon unit having rolls of different diameters can be provided, so that the ink ribbon unit can be reliably fixed in position.

EFFECT OF THE INVENTION

The present invention provides packaging that can reliably store an irregular shaped ink ribbon unit with a smaller number of components.

BEST MODE FOR CARRYING OUT THE INVENTION

First Embodiment

Packaging according to the first embodiment of the present invention is explained below with reference to the drawings. FIG. 1 shows a perspective exploded view of the packaging from which the contained items are removed. FIG. 2 is a cross-sectional view of the packaging of FIG. 1.

As shown in FIG. 1, the packaging includes a rectangular paper container 1, which accommodates a printing paper roll 2, and an ink ribbon unit 3 that is used to print onto the printing paper roll 2. The container 1 also accommodates a partition member 4 that partitions the printing paper roll 2 and the ink ribbon unit 3. The partition member 4 allows the printing paper roll 2 to be located in the left part (first storage region) of the container 1 and the ink ribbon unit 3 to be located in the right part (second storage region) of the container 1, as shown in FIG. 2.

The printing paper roll 2 is a known one. Specifically, the printing paper roll 2 has a cylindrical form as a whole, obtained by winding printing paper around a cylindrical shaft core 21. The printing paper roll 2 is placed inside a soft resin bag 22 in order to protect the printing paper. The printing paper roll 2 is then placed in the container 1 in such a manner that the shaft core 21 extends in the vertical direction. As shown in FIG. 2, the length of the shaft core 21 is substantially the same as the height of the container 1.

The ink ribbon unit is also a known one. As shown in FIG. 2, the ink ribbon unit has a sending roll 31 onto which an ink ribbon is wound, and a winding roll 32 that is arranged in parallel to the sending roll 31. These rolls 31 and 32 are connected by a linking member 33, which connects the axial ends of the sending roll with those of the winding roll. Due to such a construction, the ink ribbon unit 3 has an irregular shape with the two rolls 31 and 32 having different diameters and located side by side. Similar to the printing paper roll 2, the ink ribbon unit 3 is placed in a soft resin bag 22 before being stored in the container 1.

An explanation of the partition member is given below with reference to FIG. 3. FIG. 3 is a developed view of the partition member. As shown in FIG. 3, the partition member 4 is formed from thick paper into a panel-like shape. The partition member has a pair of rectangular holding members 41 and 42, and a band-like connecting member 43 that connects the holding members. Each of the holding members 41 and 42 has a rectangular shape with almost the same size as the top and bottom surfaces of the container 1. As shown in FIG. 2, the holding members 41 and 42 are arranged to contact each axial direction end of the printing paper roll 2 so as to sandwich the printing paper roll 2 from top and bottom. In this specification, the holding member located in the lower part of the container 1 is referred to as the first holding member 41 and the holding member located in the upper part of the container 1 is referred to as the second holding member 42. The first holding member 41 is in contact with the bottom surface 11 of the container 1 and the second holding member 42 is in contact with the top surface 12 of the container 1.

As shown in FIGS. 2 and 3, on the top of the first holding member 41, the printing paper roll 2 is located on the left side, and the ink ribbon unit 3 is located on the right side of the boundary Z. More specifically, as shown in FIG. 3, the length of the first holding member 41 in the width direction Y (in the vertical direction in FIG. 3) corresponds to the diameter D of the printing paper roll 2. The length of the first holding member 41 in the length direction X (in the horizontal direction in FIG. 3) is slightly longer than the total length of the diameter D of the printing paper roll 2 and the diameter d of the sending roll 31. The second holding member 42 has the same size as the first holding member 41. As shown in FIG. 3, in a developed view, the printing paper roll 2 is located in the right part of the drawing. In the holding members 41 and 42, through holes 47 and 48, which fix the shaft core 21, are formed in the locations where the printing paper roll 2 is disposed. The printing paper roll 2 is fixed to the holding members 41 and 42 with shaft fixing members as described later.

The portion where the ink ribbon unit 3 is located in the first holding member 41 forms the bottom surface of the second storage region.

In the first holding member 41, a pair of slits 44 extending from the right edge of the first holding member 41 in the length direction X are formed to extend the connecting member 43 to a point partway through the first holding member. The end of the connecting member serves as the above-mentioned boundary Z. The slits 44 allow the connecting member 43 to fold at a mid-part in the length direction X, i.e., at the boundary Z, rather than at the right edge of the first holding member 41. Likewise, in the second holding member 42, short slits 45 are formed from the left edge thereof. The connecting member 43 can be bent at the location N, which is slightly inward from the left edge of the second holding member 42.

In this arrangement, the partition member 4 is bent at the folds Z and N to form a U-like shape, and then stored in the container 1 as shown in FIG. 2. In the container 1, having the connecting member 43 in between, the printing paper roll 2 is stored in the first storage region 15, which is located in the left part of the container 1, and the ink ribbon unit 3 is stored in the second storage region 16, which is located in the right part of the container 1. In this arrangement, because the fold Z in the lower part of the connecting member 43 is formed in the mid-part of the first holding member 41, the width of the second storage region 16 becomes narrower in the direction from the bottom to the top as seen from the front view. Therefore, the ink ribbon unit 3 is stored with the axes of the rolls 31 and 32 perpendicular to the shaft core 21 of the printing paper roll 2. The sending roll 31, which has a larger diameter, is placed in the lower part and the winding roll 32, which has a smaller diameter, is placed in the upper part of the container 1.

The printing paper roll 2 stored in the first storage region 15 is fixed using shaft fixing members described below. The shaft fixing members 5 each includes a cylindrical main body 51 that fits into the through holes 47 and 48 formed in the holding members 41 and 42, respectively, and a flange 52 that projects radially from one axial direction edge. As shown in FIG. 2, one shaft fixing member 5 is inserted into each of the through holes 47 and 48 from the surfaces of the holding members 41 and 42 opposing the printing paper roll 2 in such a manner as to project into the roll 2. Here, the flange 52 is fitted to the periphery of the through holes 47 and 48. Therefore, the shaft fixing members 5 are fastened so they will not be dislodged from the holding members 41 and 42. By storing the thus-obtained partition member 4, printing paper roll 2, and ink ribbon unit 3 in the container 1, the packaging of the present embodiment is completed.

As described above, the fold Z in the lower part of the connecting member 43 is located in a mid-part of the first holding member 41 in the present embodiment. This makes the second storage region 16, in which the ink ribbon unit 3 is stored, become narrower from the bottom to the top thereof. In other words, this structure provides a storage space that is suitable for the ink ribbon unit 3, which has rolls of different diameters. This makes it possible to reliably fix the ink ribbon unit 3 in the container. Furthermore, the partition member 4 that partitions the printing paper roll 2 and the ink ribbon unit 3 is formed simply from a pair of holding members 41 and 42 and the connecting member 43 as described above. This makes any additional parts for filling gaps unnecessary, i.e., it reduces the number of parts required, and accordingly reduces the production cost.

The partition member may take various forms in the present embodiment. There is no limitation to the structure of the partition member as long as, when the partition member is stored in the container, its connecting member obliquely extends as seen from the front view, and the second storage region becomes narrower from one end to the other. In the present embodiment, the partition member 4 is integrally formed, but it can be separately formed and then connected afterward. In this case, for example, the connecting member may be formed as a separate part and pivotably connected at a mid-part of the holding member. It is also possible to form the partition member from a simple U-shaped panel as long as a connecting member located in a mid-part of the holding member extends obliquely.

Second Embodiment

The packaging of the second embodiment of the present invention is explained below. FIG. 4 is a perspective view illustrating the assembly of the packaging of the present embodiment. FIG. 5 is a developed view of the partition member. FIG. 6 is a cross-sectional view of the packaging, and FIG. 7 is a sectional view taken along the line A-A of FIG. 6.

As shown in FIG. 4, this packaging includes two printing paper rolls 2 and two ink ribbon units 3 accommodated in a container 1. Since the printing paper roll 2 and the ink ribbon unit 3 are the same as those used in the first embodiment, the same reference numerals are applied. The container 1 further accommodates a partition member 6, and this partition member 6 separates the container 1 into a first storage region 15, in which the printing paper rolls 2 are held, and a second storage region 16, in which the ink ribbon units 2 are held (see FIG. 6). In the container 1, a filling member 7, which fills the gaps between the ink ribbon units 3 and the inner walls of the container 1 is provided.

The partition member 6 is explained below with reference to FIG. 5. As shown in FIG. 5, the partition member 6 is formed from thick paper and has a panel-like shape. The partition member has a first holding member 61 located immediately below the printing paper rolls 2 and a second holding member 62 located immediately above the printing paper rolls 2, and a narrow connecting member 63 that connects the holding members 61 and 62. The first holding member 61 is formed from two holding member parts, i.e., a first holding member part 611 and a second holding member part 612, which are connected to each other by a fold M. When the package is used, these holding member parts 611 and 612 are folded and stacked, and disposed below the paper rolls 2 (FIG. 4). The first holding member part 611 is connected to the connecting member 63. Both holding member parts 611 and 612 have an outer shape that is substantially the same size as the bottom surface of the container 1, and the second holding member 62 is smaller than this.

As shown in FIG. 5, in the first holding member part 611, two printing paper rolls 2 are located on the right side of the boundary Z, which extends in the Y direction (in the vertical direction in FIG. 5), and the ink ribbon units 3 are located on the left side. To be more specific, the total length of the holding member part 611 in the Y direction corresponds to the total length of the diameters of the two printing paper rolls 2. In contrast, the length of the first holding member part 611 in the X direction (in the horizontal direction in FIG. 5) is slightly longer than the total length of the diameter D of the printing paper rolls 2 and the diameter d of the sending rolls 31.

As shown in FIG. 4, the second holding member 62 is located above the first storage region of the first holding member 61 so as to cover the top surfaces of the printing paper rolls 2. Therefore, the second holding member 62 has a length in the X direction that is almost the same as the diameter D of one printing paper roll, and in the Y direction almost the same as the total length of the diameters D of two printing paper rolls 2. As in the First Embodiment, through holes 6111, 6121, and 621 are formed in the holding members 61 and 62, at the locations in which the printing paper rolls 2 are provided. The printing paper rolls 2 are fixed to the holding members 61 and 62 using shaft fixing members 5.

In the first holding member part 611, two pairs of slits 6115 are formed in such a manner that they extend from the left edge of connecting member 63 in the length direction X. The left ends of the two central slits 6115 are connected to each other by slit 6114, which extends in the Y direction. By having such slits, as shown in FIG. 4, two legs 631 are formed in the lower portion of the connecting member 63. The two legs 631 extend to a mid-part of the first holding member part 611 and are connected to a fold L (boundary Z). In contrast, three projections 6112 and 6113 are formed at the edge of the first holding member part 611 to form the bottom surface of the second storage region. Note that the right end of the connecting member 63 is connected to the edge of the second holding member 62 by the fold N.

As described above, the partition member 4 is bent at the fold L and the fold N at the edge of the second holding member 62 so as to form a U-like shape and then stored in the container 1, as shown in FIG. 4. Unlike the First Embodiment, the connecting member 63 extends substantially vertically so that the first and second storage regions 15 and 16 are formed into rectangular shapes. As shown in FIG. 6, in the second storage region 16, one of the ink ribbon units 3 is arranged with the sending roll 31 facing downward and the winding roll 32 facing upward. This forms a gap next to the ink ribbon unit 3 due to the difference in the diameters of the upper winding roll 32 and the sending roll 31. The sending roll 31 of the other ink ribbon unit 3 fits into this gap. Specifically, the other ink ribbon unit 3 is arranged so that the winding roll 32 faces downward and the sending roll 31 faces upward. This arrangement makes it possible to store the two ink ribbon units 3 in the second storage region 16 without forming a gap in the vertical direction.

As shown in FIG. 7, the length of the ink ribbon unit 3 in the axial direction is shorter than the length of the first holding member part 611 in the Y direction. Therefore, a filling member 7 is provided to fill each of the gaps formed between the ends of the ink ribbon units 3 in an axial direction and the inner surfaces of the container 1. As shown in FIGS. 4 and 7, the filling member 7 is integrally formed by folding a band-like thick paper. The filling member 7 is formed from a pair of fillers 71 and a connecting member 72, which connects the fillers 71. Each filler 71 is folded so as to form a rectangular shape and then disposed between one end of the ink ribbon units 3 in the axial direction and the inner surfaces of the container 1. The fillers 71 have almost the same height as the container 1. The connecting member 72 connects the lower ends of the fillers 71, and has almost the same length as the first holding member part 611 in the Y direction. The connecting member 72 is arranged so as to span the three projections 6112 and 6113. As described above, in order to integrally form the filling member 7, a connecting member 72 for connecting the fillers 71 is required. However, in the present embodiment, the projection 6113 at the center of the first holding member part 611 supports the connecting member 72 so as to prevent the connecting member 72 from bending downward.

Using components structured as above, this packaging is assembled as shown in FIG. 4. Specifically, the partition member 6 is folded to form first and second storage regions. After arranging two printing paper rolls 2 in the first storage region 15, the printing paper rolls 2 are fixed to the partition member 6 by the shaft fixing members 5. Subsequently, two ink ribbon units are stored between the fillers 71 of filling member 7 as descried above, and then placed in the second storage region 16 of the partition member 6. The thus-fabricated components are stored in the container 1, completing the packaging.

As described above, the present embodiment is structured as follows. The rectangular-like second storage region 16 is formed using the partition member 6. The winding roll 32 of one of the ink ribbon units 3 is fitted into the gap formed by the difference in the diameters of the winding roll 32 and the sending roll 31 of the other ink ribbon unit 3. The two sending rolls 31 are arranged to face each other having the two winding rolls 32 therebetween. In this way, by arranging the smaller-diameter winding rolls 32 side-by-side, the difference in diameters between the winding rolls 32 and the sending rolls 31 can be cancelled for the irregular shaped ink ribbon unit 3. As a result, the formation of needless space in the container 1 can be prevented, and additional components to fill the gaps become unnecessary.

As in the First Embodiment, the partition member 6 may take various forms as long as a second storage region is disposed in such a manner that at least two ink ribbon units 3 can mutually fill the gaps therebetween.

Also, in addition to the structure described above, the filling member 7 may, for example, take the form shown in FIGS. 8 and 9. FIG. 8 shows the filling member being used, and FIG. 9 is a developed view of the filling member.

As shown in FIG. 9, the filling member 7 is formed from a pair of fillers 71 and a band-like connecting member 72 that connects the pair of fillers 71. Each filler 71 has a rectangular central portion 711 that is foldably connected to each end of the connecting member 72, and a pair of rectangular side portions 712 that are foldably connected to each side of the central portion 711. The central portion 711 and the side portions 712 have a length that is substantially the same as the height of the container 1. As shown in FIG. 8, in order to place the filling member 7 in the container 1, the central portions 711 are folded perpendicular to the connecting member 72, which is disposed horizontally, and each of the side portions 712 are folded at a right angle to the central portion 711. In this case, each side portion 712 should be folded opposite to the connecting member 72, i.e., in such a manner that the side portion 712 faces the outside of the packaging. In this arrangement, the filler 71 forms substantially a rectangular shape as seen in a plan view so as to fill the gaps between the ends of the ink ribbon units 3 and the container 1. In this structure, as shown in FIG. 8, by placing the filling member 7 in the container 1 and arranging the ink ribbon units 3 between the fillers 71, the ink ribbon unit 3 can be held in a predetermined position in the container 1.

In FIG. 4, three projections 6112 and 6113 are formed on the first holding member 61 of the partition member 6. However, the central projection 6113 is not always necessary and may be omitted as shown in FIG. 8.

Embodiments of the present invention are explained above. However, the scope of the present invention is not limited to these embodiments and various modifications may be added insofar as they do not depart from the intention of the present invention. Examples in which one or two ink ribbon units are stored are explained above. However, three or more ink ribbon units can be stored by suitably combining the packaging of the first and second embodiments.

Also, the means for fixing the printing paper roll 2 to the holding member may have a structure other than that of the shaft fixing members 5 described above. There is no limitation to the structure of the fixing member as long as it can fix the printing paper roll to the holding member. In the above embodiments, the printing paper roll 2 is placed in such a manner that its axial direction is perpendicular to the bottom surface of the second storage region. However, the arrangement of the printing paper roll 2 is not limited to this and may be placed parallel to the bottom surface of the second storage region if a fixing member is provided. In the above explanation, the printing paper roll 2 is provided with a shaft core 21. However, such a shaft core 21 is not always necessary, and a coreless printing paper roll in which printing paper is wound to form a roll without having a shaft core may also be used.

EXPLANATION OF REFERENCE NUMERALS

Figure 1:
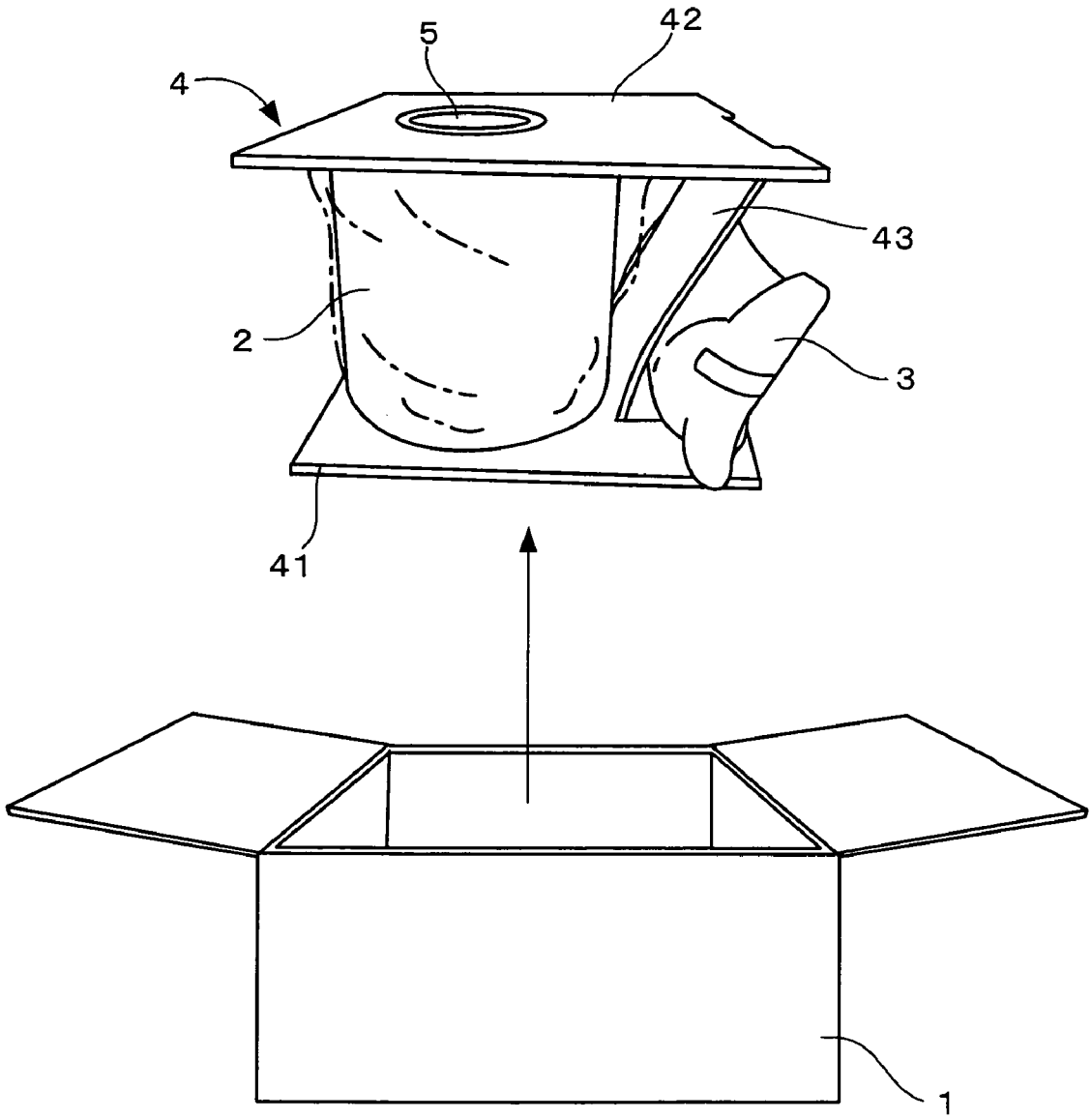
FIG. 1 is a perspective exploded view showing packaging according to the first embodiment of the present invention.
Figure 2:
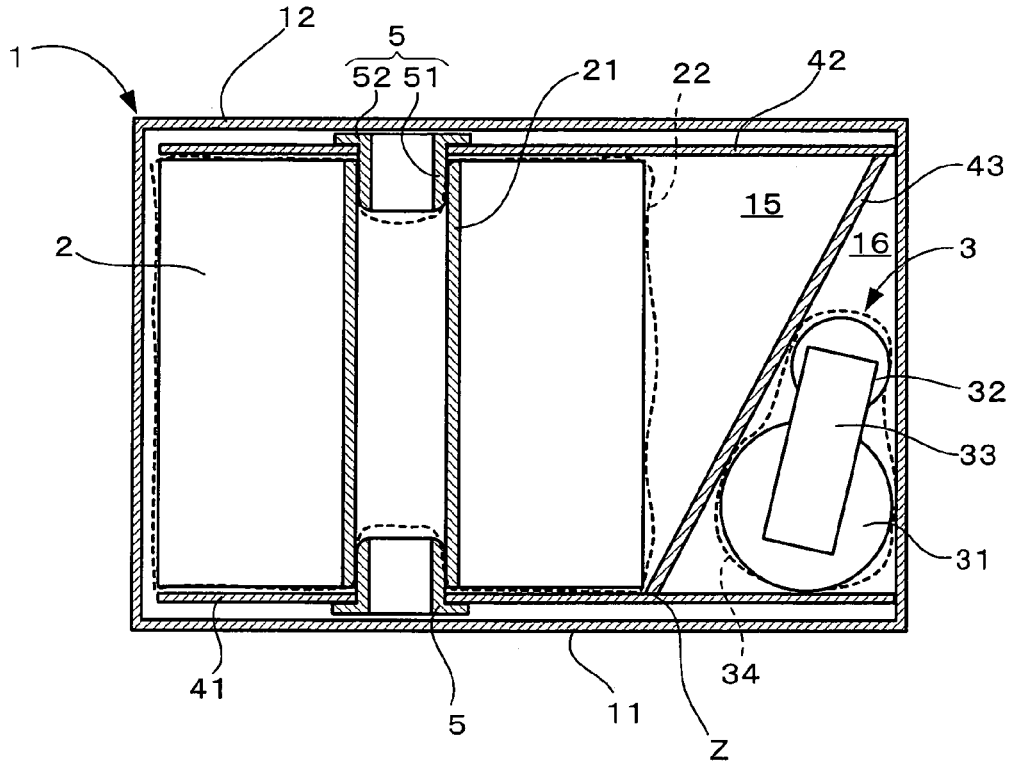
FIG. 2 is a cross-sectional view of the packaging shown in FIG. 1.
Figure 3:
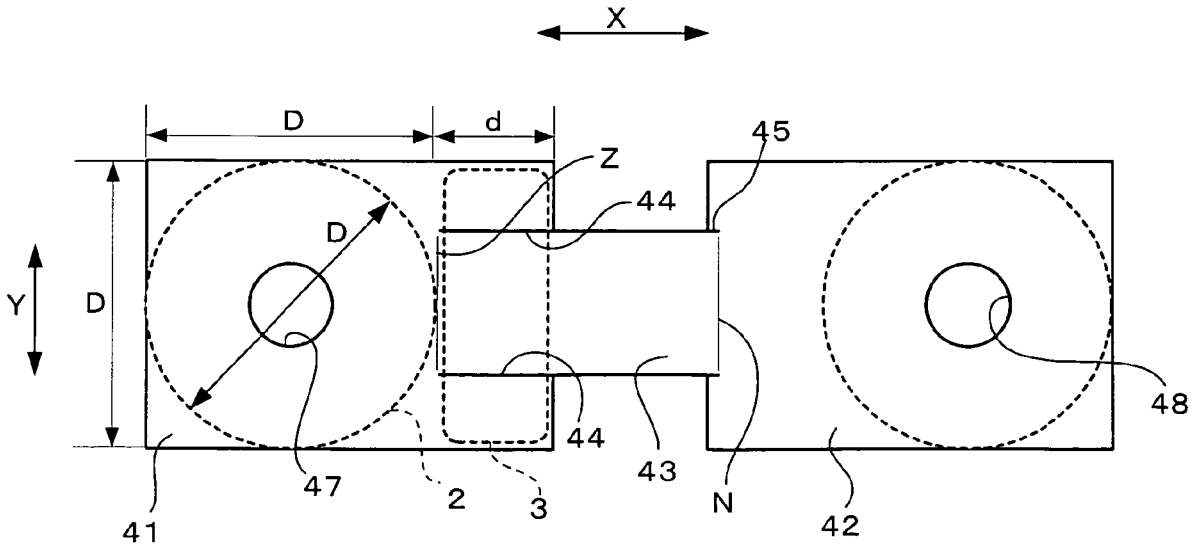
FIG. 3 is a developed view of a partition member.
Figure 4:
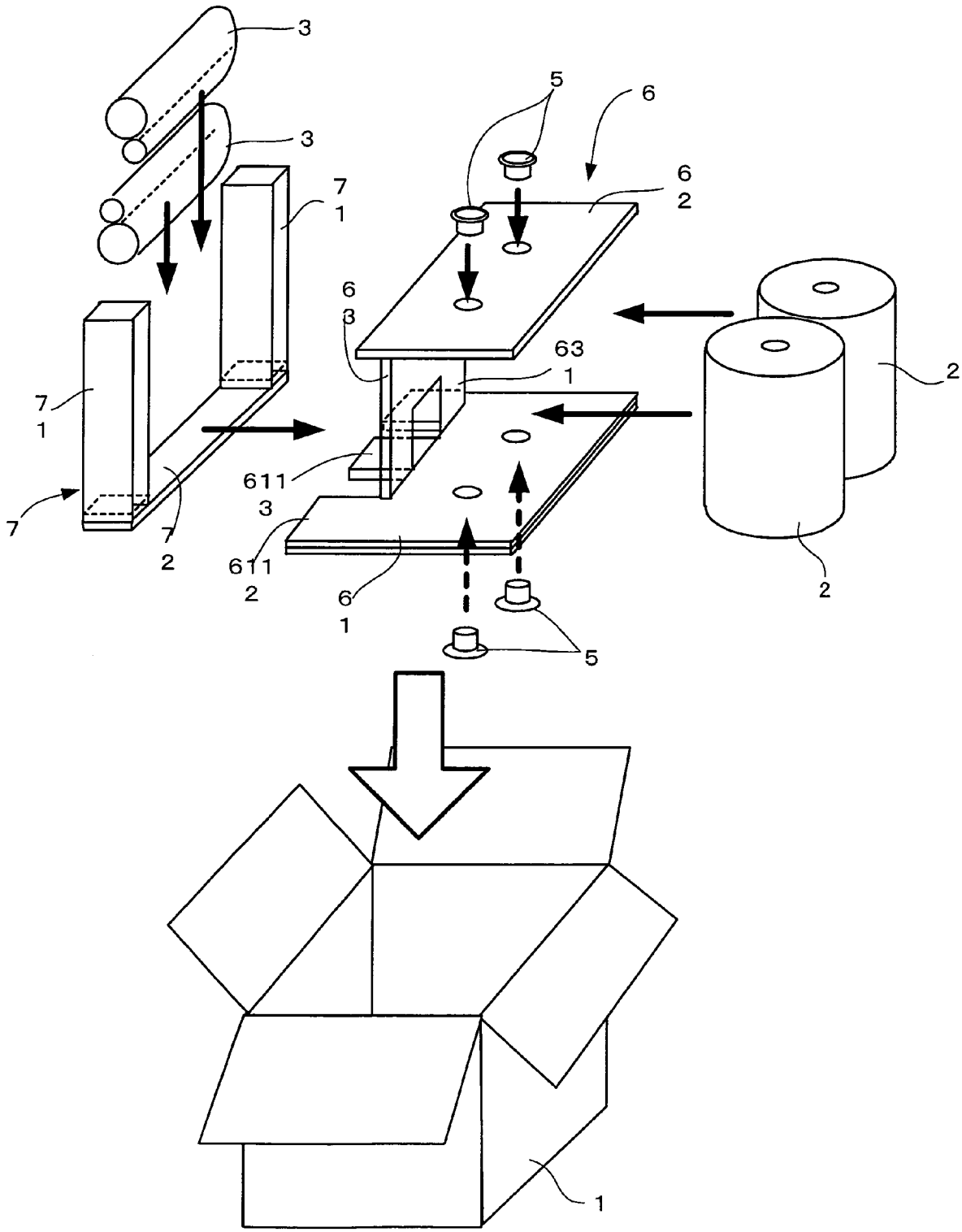
FIG. 4 is a perspective exploded view showing packaging according to the second embodiment of the present invention.
Figure 5:
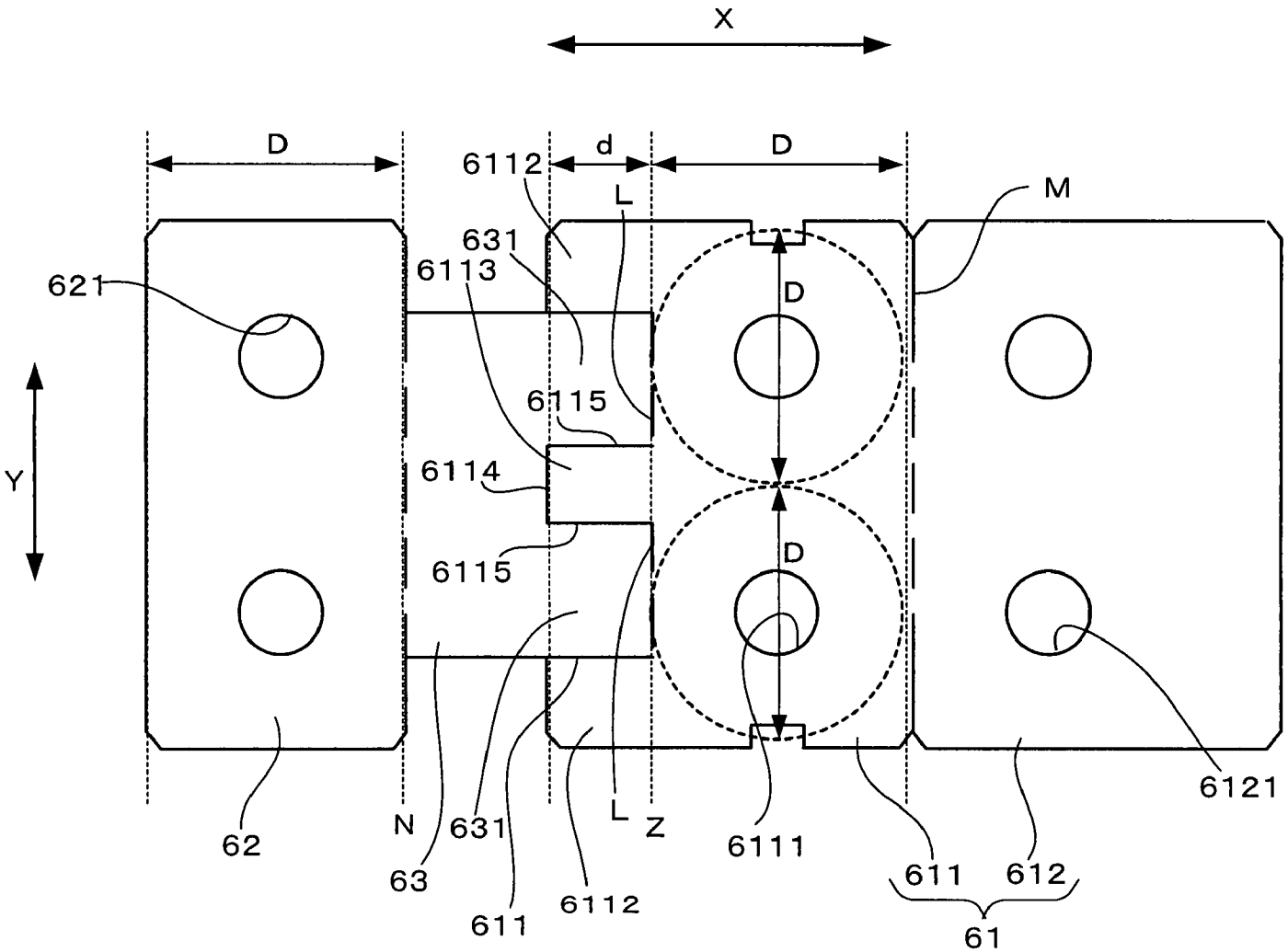
FIG. 5 is a developed view of a partition member.
Figure 6:
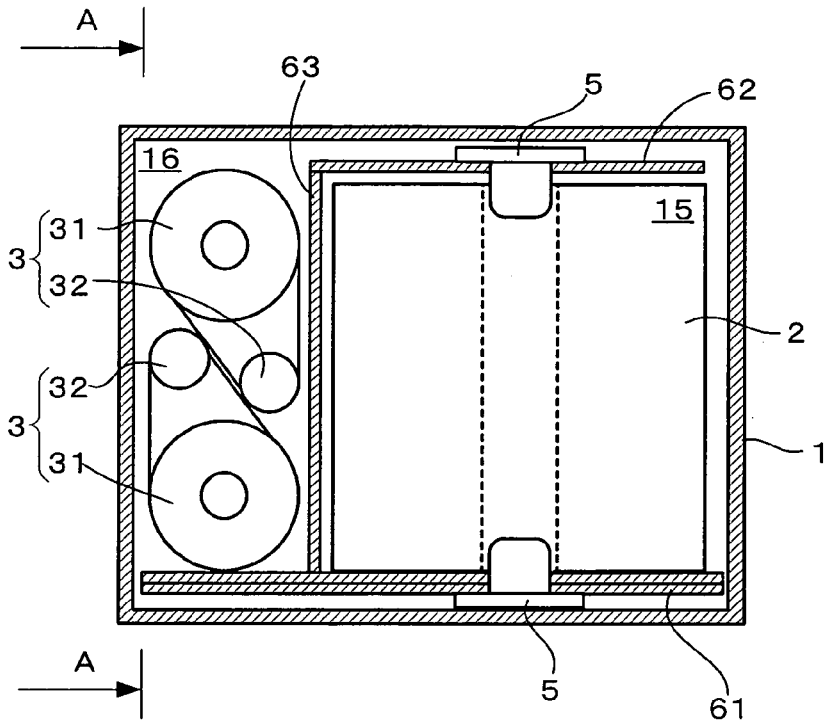
FIG. 6 is a cross-sectional view of the packaging shown in FIG. 4.
Figure 7:
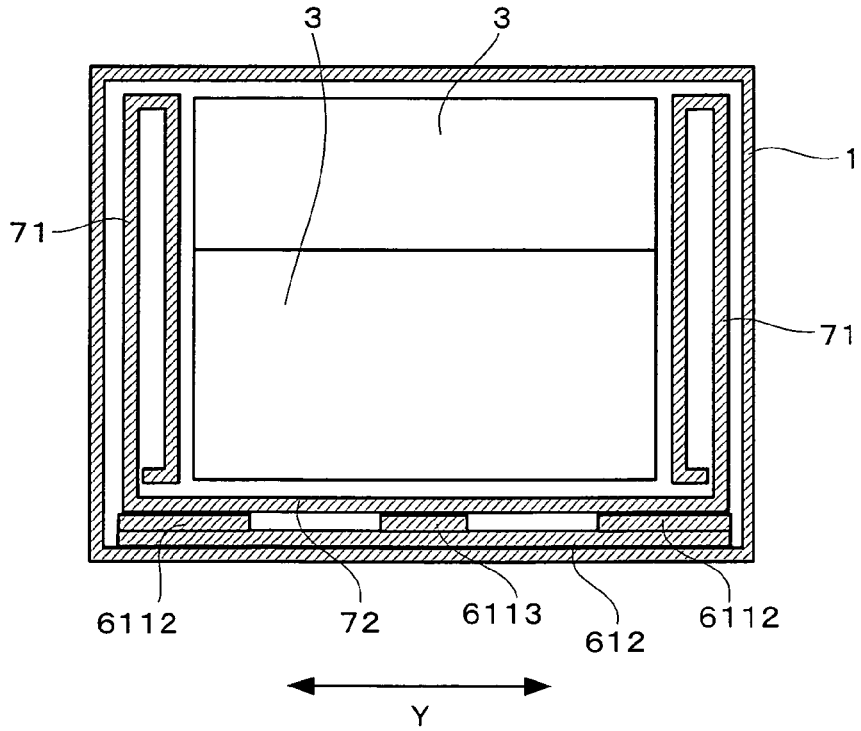
FIG. 7 is a cross-sectional view taken along the line A-A of FIG. 6.
Figure 8:
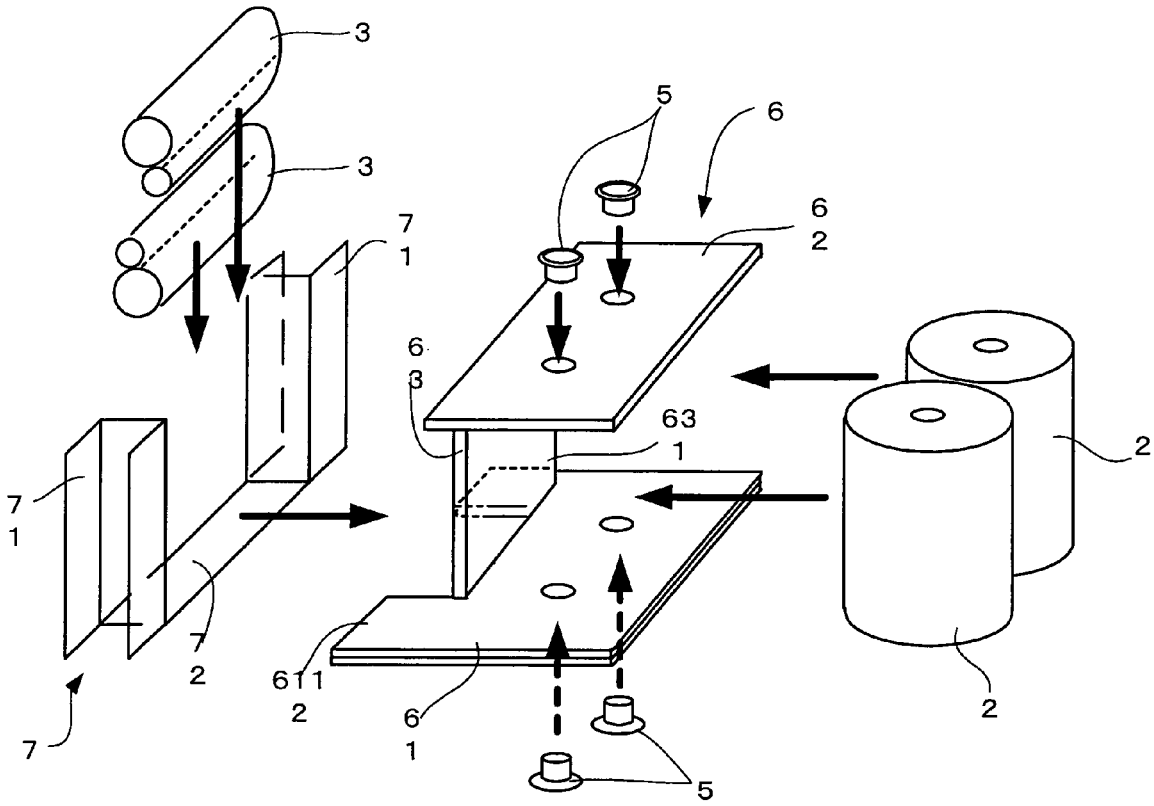
FIG. 8 is a perspective view showing another example of the packaging of FIG. 4.
Figure 9:
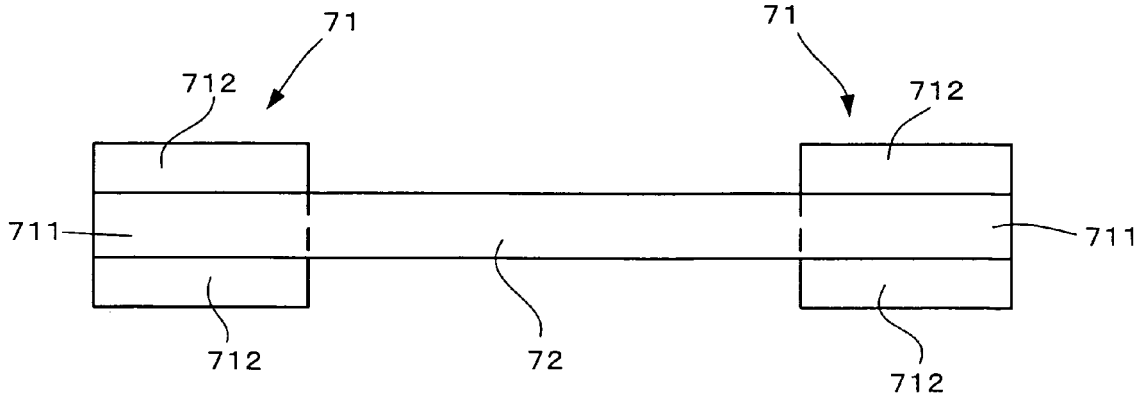
FIG. 9 is a developed view of the filling member used in FIG. 8.

1 container
2 printing paper roll
3 ink ribbon unit
4 partition member
41 first holding member
42 second holding member
43 connecting member
6 partition member
61 first holding member
62 second holding member
7 filling member

The invention claimed is:

1. Packaging comprising:

a printing paper roll that is wound with printing paper;

an ink ribbon unit that has both a sending roll that is wound with an ink ribbon, the sending roll having a shaft, and a winding roll that is disposed in parallel to the sending roll, the winding roll also having a shaft;

a container for holding the printing paper roll and the ink ribbon unit; and a partition member that partitions the container into a first storage region having a top surface and a bottom surface, and a second storage region, having a top surface and a bottom surface, into which the printing paper roll and the ink ribbon unit are stored, respectively;

wherein the ink ribbon unit is arranged in such a manner that the shafts of the sending roll and winding roll are parallel to the bottom surface of the second storage region; and the partition member extends with an inclination relative to a direction perpendicular to the bottom surface of the second storage region.

2. Packaging comprising: at least two printing paper rolls that are wound with printing paper;

at least two ink ribbon units that each has both a sending roll that is wound with an ink ribbon, the sending roll having a shaft, and a winding roll that is disposed in parallel to the sending roll, the winding roll also having a shaft;

a container for holding the printing paper rolls and the ink ribbon units; and a partition member for partitioning the container into a first region having a top surface and a bottom surface in which the printing paper rolls are disposed, and a second region having a top surface and a bottom surface in which the ink ribbon units are disposed;

wherein the ink ribbon units are arranged in such a manner that the shafts of the sending roll and winding roll are parallel to the bottom surface of the second storage region;

said at least two ink ribbon units are arranged in such a manner that the gap formed by the difference in the diameters between the winding roll and the sending roll in each ink ribbon unit is engaged with the winding roll of the other ink ribbon unit; and the at least two sending rolls are arranged to be opposed each other having the at least two winding rolls therebetween.

3. The packaging according to claim 1, wherein the printing paper roll contains a shaft core part that is disposed perpendicular to the bottom surface of the second storage region;

the partitioning member comprises a pair of holding members for holding the printing paper roll at its ends in an axial direction and a connecting member for connecting the holding members; and the connecting member forms a boundary between the first and second storage regions.

4. The packaging according to claim 3, wherein the printing paper roll has a cylindrical shaft core space in the shaft core part, and a shaft fixing member is provided for each of the holding members in such a manner that the shaft fixing member projects into the printing paper roll and fits into the shaft core space.

5. The packaging according to claim 3 wherein:

the partitioning member is integrally formed and aligned such that its parts have an arrangement of (i) one holding member, (ii) a connecting member, and (iii) the other holding member the connecting member has a width that is smaller than that of at least one holding member;

the connecting member extends to a mid-part of one holding member due to slits that are formed in a longitudinal direction of the connecting member; and the connecting member can be folded at the mid-part.

6. The packaging according to claim 3, wherein at least one of the holding members has a size substantially equal to the container to which the holding member is adjacent.

7. The packaging according to claim 3, wherein a filling member is placed in a gap that is formed between at least one end of the ink ribbon unit and an inner surface of the container in an axial direction of the ink ribbon unit.

8. The packaging according to claim 2, wherein the printing paper roll contains a shaft core part that is disposed perpendicular to the bottom surface of the second storage region;

the partitioning member comprises a pair of holding members for holding the printing paper roll at its ends in an axial direction and a connecting member for connecting the holding members; and the connecting member forms a boundary between the first and second regions.

9. The packaging according to claim 8, wherein the printing paper roll has a cylindrical shaft core space in the shaft core part, and a shaft fixing member is provided for each of the holding members in such a manner that the shaft fixing member projects into the printing paper roll and fits into the shaft core space.

10. The packaging according to claim 8, wherein:

the partitioning member is integrally formed and aligned such that its parts have an arrangement of (i) one holding member, (ii) a connecting member, and the other holding member;

the connecting member has a band-like shape with a width that is smaller than that of the holding member;

the connecting member extends to a mid-part of one holding member due to slits that are formed in a longitudinal direction of the connecting member; and the connecting member can be folded at the mid-part.

11. The packaging according to claim 8, wherein at least one of the holding members has a size substantially equal to the container to which the holding member is adjacent.

12. The packaging according to claim 8, wherein a filling member is placed in a gap that is formed between at least one end of the ink ribbon unit and an inner surface of the container in an axial direction of the ink ribbon unit.

* * * * *